US010123130B2

(12) United States Patent
Akino

(10) Patent No.: US 10,123,130 B2
(45) Date of Patent: Nov. 6, 2018

(54) DIAPHRAGM, ELECTROACOUSTIC TRANSDUCER, AND ELECTROACOUSTIC TRANSDUCER APPARATUS

(71) Applicant: Hiroshi Akino, Kanagawa (JP)

(72) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 3 days.

(21) Appl. No.: 15/159,123

(22) Filed: May 19, 2016

(65) Prior Publication Data

US 2016/0345097 A1 Nov. 24, 2016

(30) Foreign Application Priority Data

May 20, 2015 (JP) ..... 2015-102541
May 19, 2016 (JP) ..... 2016-100093

(51) Int. Cl.
*H04R 19/01* (2006.01)

(52) U.S. Cl.
CPC ..... *H04R 19/016* (2013.01); *H04R 2307/025* (2013.01)

(58) Field of Classification Search
CPC .. H04R 7/14; H04R 19/016; H04R 2307/025; Y10T 29/49005; F02C 7/045; E04C 2/365; G02B 5/126; B22F 3/1115
See application file for complete search history.

(56) References Cited

U.S. PATENT DOCUMENTS 3,018,205 A * 1/1962 Barut ..... B21D 3/02 428/116
4,340,301 A * 7/1982 Schwab ..... G02B 5/126 359/542
2008/0044621 A1* 2/2008 Strauss ..... B22F 3/1112 428/108
2008/0212808 A1* 9/2008 Omoda ..... H04R 7/14 381/191
2009/0296963 A1* 12/2009 Akino ..... H04R 7/14 381/174

FOREIGN PATENT DOCUMENTS

JP 5055203 B2 10/2012

* cited by examiner

*Primary Examiner* — Fan Tsang
*Assistant Examiner* — Angelica M McKinney
(74) *Attorney, Agent, or Firm* — W&C IP

(57) ABSTRACT

A diaphragm is provided that has small mechanical anisotropy even when heat is applied to the diaphragm in the production process. The diaphragm includes a biaxially stretched film stretched in a first direction (the machine direction) and a second direction (the transverse direction), wherein the entire surface of the biaxially stretched film has a first pattern and a second pattern, the first pattern has ridges and grooves with a first pitch, the second pattern has ridges and grooves with a second pitch, the second pitch is smaller than the first pitch, the second pattern is formed along the first direction or the second direction, and the length of regions defined by the first pattern in the first direction differs from the length of the regions in the second direction.

8 Claims, 4 Drawing Sheets

DIAPHRAGM, ELECTROACOUSTIC TRANSDUCER, AND ELECTROACOUSTIC TRANSDUCER APPARATUS

TECHNICAL FIELD

The present invention relates to a diaphragm, an electroacoustic transducer, and an electroacoustic transducer apparatus.

BACKGROUND ART

Condenser microphones are electroacoustic transducer apparatuses including electroacoustic transducers that convert acoustic waves to electrical signals. An electroacoustic transducer of a condenser microphone includes a diaphragm ring, a diaphragm, a spacer, and a fixed electrode. The diaphragm is stretched on the diaphragm ring with predetermined tension. The fixed electrode is disposed adjacent to the diaphragm with the spacer disposed therebetween.

An electrostatic attraction force is applied to a diaphragm of a condenser microphone operated by a DC bias even when no sound pressure is applied. Such an electrostatic attraction force causes the diaphragm to undesirably stick to the fixed electrode. The contact of the diaphragm with the fixed electrode should be avoided even when high sound pressure is applied to the diaphragm.

The limit of the sound collection in a low frequency band of a first order pressure-gradient microphone depends on the tension of the diaphragm. That is, when the tension of the diaphragm increases, the limit of the sound collection in a low frequency band shifts to a high frequency region. On the other hand, when the tension of the diaphragm decreases, the limit of the sound collection in a low frequency band shifts to a low frequency region. As a result, the frequency response of the diaphragm in the low frequency band is to be improved, and the counteract force of the diaphragm against the adsorption force to the fixed electrode is to be weakened.

Schemes have been proposed to improve the frequency response of the diaphragm in a low frequency band and to improve the counteract force of the diaphragm against the adsorption force to the fixed electrode (for example, refer to Japanese Patent No. 5055203).

In general, a diaphragm is composed of a thermoplastic resin film such as a polyethylene terephthalate film or a polyphenylene sulfide film. The thermoplastic resin film is a biaxially stretched film stretched in the longitudinal and lateral directions. Thus, the mechanical properties, such as tensile strength, of the diaphragm in the longitudinal and lateral direction, and the temperature dependency of the mechanical properties of the diaphragm depend on the stretched direction of the stretched film.

The diaphragm proposed in Japanese Patent No. 5055203 is prepared through corrugating. The diaphragm having a pattern with a large-pitched ridges and grooves achieves the same advantageous effects as those of a diaphragm having multiple ribs. Thus, the diaphragm operates in the same manner as a diaphragm having multiple small compartments. As a result, the mechanical anisotropy of the stretched film of the diaphragm becomes small. Thus, even in rectangular diaphragms, the individual differences in the natural resonance frequencies of the individual diaphragms becomes small through matching of the stretched direction of the stretched film with the extending direction of the long or short side of the diaphragms, in a production process of the diaphragms.

SUMMARY OF INVENTION

Technical Problem

The production process of a diaphragm includes steps involving heating of the diaphragm, such as bonding of the diaphragm to a diaphragm ring. The mechanical anisotropy of the tensile strength of a stretched film depends on the temperature. Thus, the natural resonance frequency of the diaphragm depends on the stretched direction of the stretched film and the extending direction of the long or short side of the diaphragm. As a result, the natural resonance frequencies of the diaphragms have individual differences.

An object of the present invention is to solve the problem described above and to provide a diaphragm having small mechanical anisotropy even when heat is applied to the diaphragm in the production process of the diaphragm.

Solution To Problem

The diaphragm according to the present invention includes a biaxially stretched film stretched in a first direction and a second direction, wherein the entire surface of the biaxially stretched film has a first pattern and a second pattern, the first pattern has ridges and grooves with a first pitch, the second pattern has ridges and grooves with a second pitch, the second pitch is smaller than the first pitch, the second pattern is formed along the first direction or the second direction, and the length of regions defined by the first pattern in the first direction differs from the length of the regions in the second direction.

According to the present invention, a diaphragm having small mechanical anisotropy can be provided.

DESCRIPTION OF EMBODIMENTS

Embodiments of a diaphragm, an electroacoustic transducer, and an electroacoustic transducer apparatus according to the present invention will now be described with reference to the attached drawings.

<Electroacoustic Transducer>

An electroacoustic transducer according to the present invention will now be described. In the description below, a static electroacoustic transducer converting acoustic waves to electrical signals will be described as an example of an electroacoustic transducer. The electroacoustic transducer constitutes a condenser microphone unit.

Figure 1:
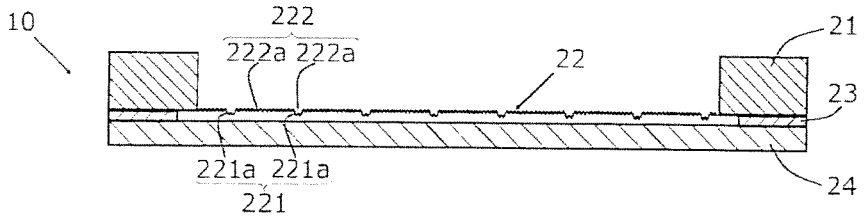
FIG. 1 is a schematic cross-sectional view illustrating an embodiment of an electroacoustic transducer according to the present invention.

FIG. 1 is a schematic cross-sectional view illustrating an embodiment of an electroacoustic transducer according to the present invention.

Figure 2:
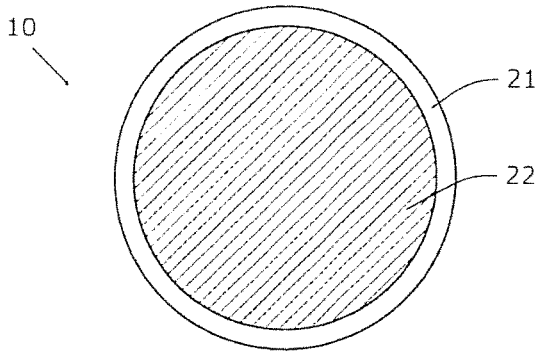
FIG. 2 is a plan view of the electroacoustic transducer in FIG. 1.

FIG. 2 is a plan view of the electroacoustic transducer according to the present invention.

An electroacoustic transducer 10 includes a diaphragm holder (diaphragm ring) 21, a diaphragm 22, a spacer 23, and a fixed electrode 24. The diaphragm 22 is stretched on the diaphragm holder 21 with predetermined tension. The diaphragm 22 and the fixed electrode 24 constitute a capacitor. The capacitance of the capacitor varies with the vibration of the diaphragm 22 generated in response to acoustic waves from a sound source.

The diaphragm 22 is disposed adjacent to the fixed electrode 24 with the spacer 23 disposed therebetween. An air layer (gap) having a thickness equivalent to that of the spacer 23 is positioned between the diaphragm 22 and the fixed electrode 24.

Details of the diaphragm 22 will be described below.

The spacer 23 is composed of synthetic resin, for example. The spacer 23 has a shape of a thin ring.

The fixed electrode 24 is composed of metal, such as aluminum. The fixed electrode 24 has a shape of a disc. An electret plate is bonded to at least one of the faces of the fixed electrode 24, for example, the face adjacent to the diaphragm 22. The fixed electrode 24 and the electret plate constitute an electret board.

<Diaphragm>

The diaphragm according the present invention will now be described.

The diaphragm 22 is composed of a thermoplastic resin film, such as a polyethylene terephthalate film or a polyphenylene sulfide film. The diaphragm 22 has a shape of a circle. The thermoplastic resin film is a biaxially stretched film stretched in the longitudinal and lateral directions. Thus, the mechanical properties, such as tensile strength, of the diaphragm in the longitudinal and lateral directions, and the temperature dependency of the mechanical properties of the diaphragm depend on the stretched direction of the biaxially stretched film. An unprocessed stretched film usually stretches more readily in the transverse direction (TD) than the machine direction (MD). The MD is the traveling direction of the film (the longitudinal direction of the stretched film) during the production process of the stretched film. The TD is the direction orthogonal to the MD (the width direction of the stretched film).

Figure 3A:
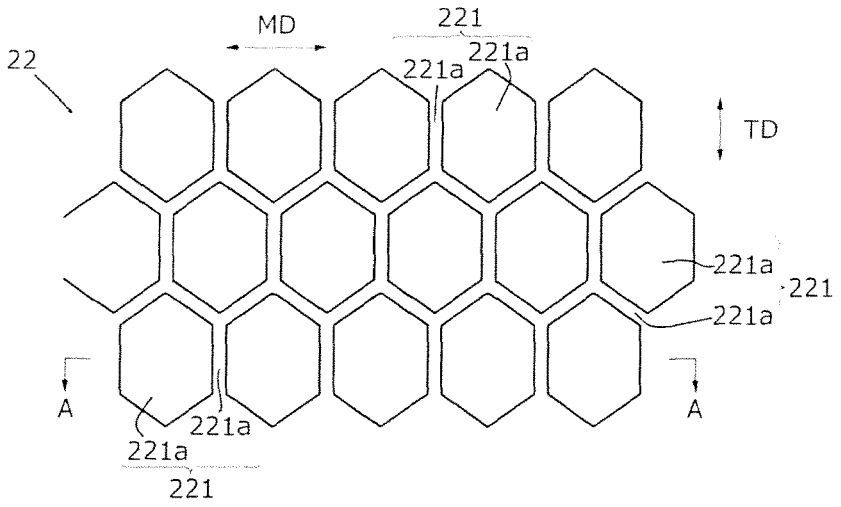
FIG. 3A is a partial plan view of the diaphragm constituting the electroacoustic transducer in FIG. 2.
Figure 3B:
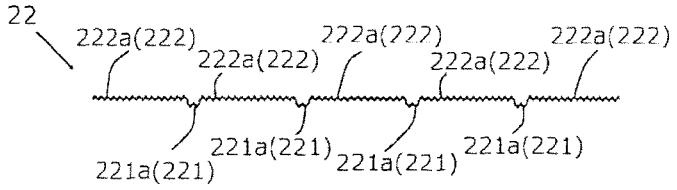
FIG. 3B is a partial cross-sectional view taken from line A-A in FIG. 3A.

FIGS. 3A and 3B illustrate an embodiment of a diaphragm according to the present invention; FIG. 3A is a partial plan view, and FIG. 3B is a partial cross-sectional view taken from line A-A in FIG. 3A.

The entire surface of the diaphragm 22 has corrugation including a first pattern 221 and a second pattern 222. The first pattern 221 is a pattern having rough ridges and grooves 221*a* with a large pitch in cross-sectional view. The second pattern 222 is a pattern having fine ridges and grooves 222*a* with a small pitch in cross-sectional view. The ridges and grooves 222*a* of the second pattern 222 are formed linearly along the TD. The multiple ridges and grooves 222*a* of the second pattern 222 are formed consecutively on the entire diaphragm 22 along the MD. In FIG. 3A, the ridges and grooves 22*a* of the second pattern 222 is not shown.

As shown in FIG. 3A, the entire diaphragm 22 is partitioned by the ridges and grooves 221*a* of first pattern 221 into multiple hexagonal (polygonal) regions in plan view. As shown in FIG. 3B, the ridges and grooves 222*a* of the second pattern 222 are formed on the entire diaphragm 22. A part of the ridges and grooves 222*a* of the second pattern 222 are surrounded by the ridges and grooves 221*a* of the first pattern 221. In the hexagonal regions defined by the ridges and grooves 221*a* of the first pattern 221, the lengths of the regions in the MD (the horizontal direction in FIG. 3A) are different from the lengths of the regions in the TD (the vertical direction in FIG. 3A).

The hexagonal regions defined by the ridges and grooves 221*a* of the first pattern 221 have a length in the TD that is longer than the length in the MD. The stretch ability in the MD of the diaphragm 22 processed in such a manner improves. As a result, the difference in the tensions of the diaphragm 22 becomes small between the TD and MD.

Through corrugating with heat and pressure of the stretched film, hexagonal regions having different length in the TD and MD are formed on the entire diaphragm 22. As a result, the mechanical anisotropy of the diaphragm 22 in the MD and TD becomes small even when heat is applied to the diaphragm 22 for bonding of the diaphragm 22 to the diaphragm holder 21, for example. Thus, the tension of the diaphragm 22 becomes stable. A preferred shape of the regions defined by the ridges and grooves 221*a* of the first pattern 221 is a polygon with no side orthogonal to the TD in plan view. When the polygonal regions defined by the first pattern 221 have sides orthogonal to the TD, the effect of the fine ridges and grooves of the second pattern 222, which described below, in the TD is partially lost. Thus, the stretch ability of the diaphragm 22 becomes low.

Figure 4:
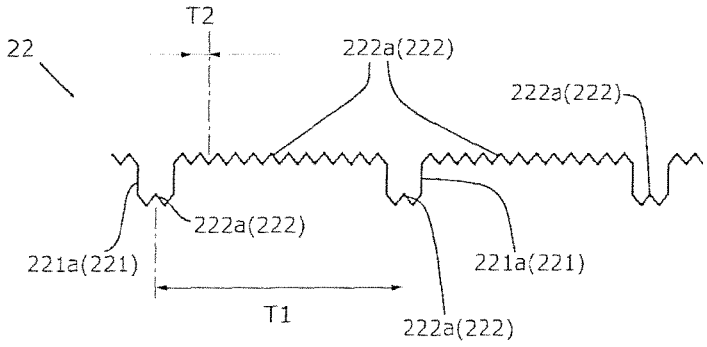
FIG. 4 is a partially enlarged cross-sectional view of the diaphragm in FIG. 3B.

FIG. 4 is a partially enlarged cross-sectional view of the diaphragm 22.

In the FIG. 4, reference sign T1 represents the pitch of the ridges and grooves 221*a* of the first pattern 221, and reference sign T2 represents the pitch of the ridges and grooves 222*a* of the second pattern 222. The ridges and grooves 221*a* of the first pattern 221 and the ridges and grooves 222*a* of the second pattern 222 are relative to each other. For example, if the portions protruding toward the fixed electrode 24 (downward in FIG. 4) are defined as grooves, the portions protruding away from the fixed electrode 24 (upward in FIG. 4) should be defined as ridges. The pitch T1 indicates the distance between adjacent grooves or ridges of the first pattern 221. The pitch T2 indicates the distance between adjacent grooves or ridges of the second pattern 222.

The pitch T1 is larger than the pitch T2. For example, the pitch T1 is at least ten times larger than the pitch T2. That is, the number of the ridges and grooves 222*a* of the second pattern 222 disposed between two adjacent grooves or ridges of the first pattern 221 is ten or more. In other words, the ratio of the pitch T1 to the pitch T2 is ten or more.

The peak-to-valley distance between the ridge and groove 221*a* of the first pattern 221 is larger than that of the peak-to-valley distance between the ridges and grooves 22*a* of the second pattern 222. In other words, the ridges and grooves 221*a* of the first pattern 221 is rougher than the ridges and grooves 222*a* of the second pattern 222. On the other hand, the ridges and grooves 222*a* of the second pattern 222 is finer than the ridges and grooves 221*a* of the first pattern 221.

The ridges and grooves 222*a* of the second pattern 222 are fine ridges and grooves having the peak-to-valley distance larger than or equal to the thickness of the diaphragm 22. The ridges and grooves 222*a* of the second pattern 222 are ridges and grooves forming corrugation (bellows) in the MD. The bellowing ridges and grooves 222*a* of the second pattern 222 improve the stretch ability of the diaphragm 22 in the MD.

As described above, the ridges and grooves 22*a* of the second pattern 222 is formed on the entire diaphragm 22 including the portions where the ridges and grooves 221*a* of the first pattern 221 are formed. That is, the surface of the diaphragm 22 includes portions where both the ridges and grooves 221*a* of the first pattern 221, and the ridges and grooves of the second pattern 222 are formed. The fine ridges and grooves 222*a* of the second pattern 222 improve the stretch ability of the diaphragm 22 in the MD. The rough ridges and grooves 221*a* of the first pattern 221 form a collection of diaphragms, which the ridges and grooves 221*a* of the first pattern 221 serve as a rib, on the diaphragm 22.

<Electroacoustic Transducer Apparatus>

An embodiment of electroacoustic transducer apparatus according to the present invention will now be described. In the description below, a condenser microphone will be described as an example of the electroacoustic transducer apparatus.

Figure 5:
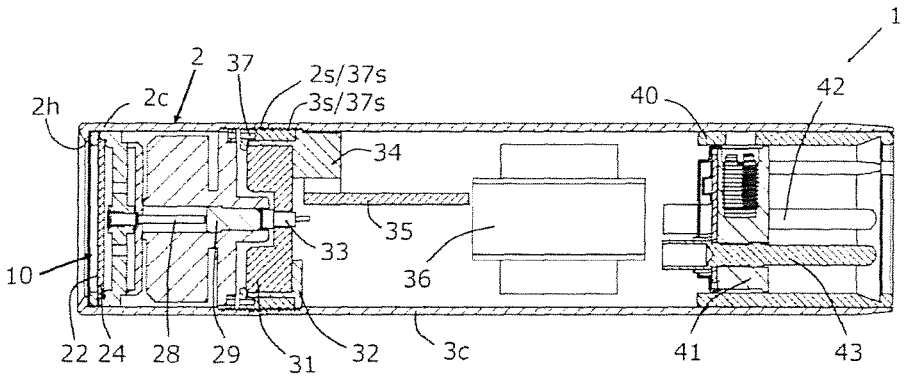
FIG. 5 is a cross-sectional side view of a condenser microphone illustrating an embodiment of an electroacoustic transducer apparatus of according to the present invention.

FIG. 5 is a cross-sectional side view of a condenser microphone illustrating an embodiment of an electroacoustic transducer apparatus according to the present invention.

A condenser microphone 1 includes a condenser microphone unit 2, a circuit case 3*c*, a connector holder 31, a holder 32, a contact probe 33, a base fixture 34, an audio-signal output circuit board 35, an output transformer 36, a connection member 37, a connector case 40, and an output connector.

Figure 6:
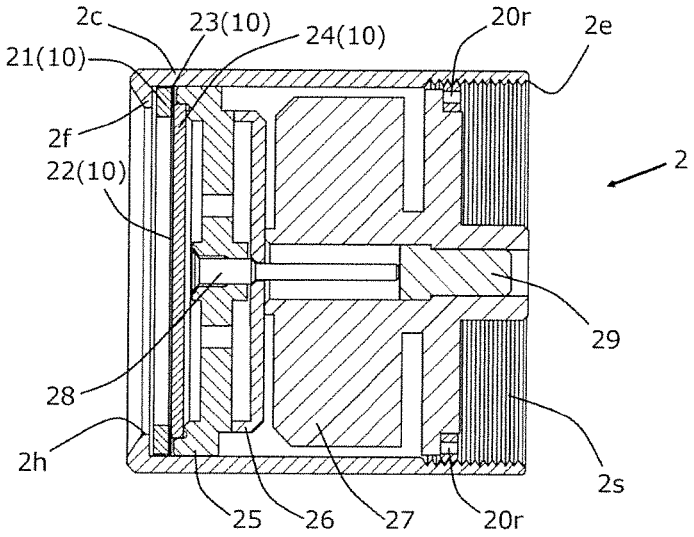
FIG. 6 is a cross-sectional side view of a condenser microphone unit constituting the condenser microphone in FIG. 5.

FIG. 6 is a cross-sectional side view of the condenser microphone unit 2. The condenser microphone unit 2 includes a unit case 2*c*, the electroacoustic transducer 10 described above, and components described below (an insulator 25, a support 26, an insulating base 27, an electrode extraction terminal 28, a contact pin 29, and a lock ring 20*r*). The electroacoustic transducer 10 and the components described below are accommodated in the unit case 2*c*.

The unit case 2*c* is composed of metal. The unit 2*c* has a shape of a hollow cylinder with a closed end. The bottom face of the unit case 2*c* is disposed at the front of the unit case 2*c* (the direction of the microphone that is directed to the sound source during sound collection, the same applies hereinafter). The unit case 2*c* has an acoustic-wave entering hole 2*h*, a flange 2*f*, an open end 2*e*, and an internal thread portion 2*s*. The acoustic-wave entering hole 2*h* introduces acoustic waves from a sound source into the unit case 2*c*. The acoustic-wave entering hole 2*h* is disposed on the bottom face of the unit case 2*c*. The flange 2*f* is composed of the bottom face of the unit case 2*c* having the acoustic-wave entering hole 2*h*. The open end 2*e* is the rear end of the unit case 2*c*. The internal thread portion 2*s* is disposed on the rear side of the inner circumferential surface of the unit case 2*c*.

The electroacoustic transducer 10 includes the diaphragm holder 21, the diaphragm 22, the spacer 23, and the fixed electrode 24, as described above.

The insulator 25 supports the fixed electrode 24 and electrically insulates the fixed electrode 24 from the unit case 2*c* and the diaphragm 22. The insulator 25 has communication holes. The penetrating direction of the communication holes is the thickness direction (the horizontal direction in FIG. 6) of the insulator 25.

The support 26 is attached to the rear face of the insulator 25 in an airtight manner. An air chamber is defined between the fixed electrode 24 and the insulator 25 and between the insulator 25 and the support 26 and are connected via the communication holes in the insulator 25.

The insulating base 27 is disposed behind the support 26. The insulating base 27 has a communication hole. The penetrating direction of the communication hole is the thickness direction (the horizontal direction in FIG. 6) of the insulating base 27.

The electrode extraction terminal 28 extracts signals from the fixed electrode 24. The electrode extraction terminal 28 is attached to the central area of the insulator 25. The rear half of the electrode extraction terminal 28 is disposed inside the front half of the communication hole of the insulating base 27.

The contact pin 29 is electrically connected to the electrode extraction terminal 28 via an elastic material such as a conductive sponge. The contact pin 29 is disposed inside the rear half of the communication hole of the insulating base 27.

The electroacoustic transducer 10 is fixed inside the unit case 2*c* with the lock ring 20*r* fit into the internal thread portion 2*s*.

Referring back to FIG. 5, the circuit case 3*c* is composed of metal. The circuit case 3*c* has a shape of a cylinder. The circuit case 3*c* has an internal thread 3*s*. The internal thread 3*s* is disposed on the inner circumferential surface of the front side of the circuit case 3*c*. The connector holder 31, the holder 32, the contact probe 33, the base fixture 34, the audio-signal output circuit board 35, the output transformer 36, and the connector case 40 are accommodated in the circuit case 3*c*.

The connector holder 31 is composed of an insulating material. The connector holder 31 is supported by the holder 32. The connector holder 31 is attached inside the front end of the circuit case 3*c* with the holder 32. The connector holder 31 has a hole. The penetrating direction of the hole is the thickness direction (the horizontal direction in FIG. 5) of the connector holder 31. The contact probe 33 is disposed inside the hole of the connector holder 31. The contact probe 33 is electrically connected to the contact pin 29 of the condenser microphone unit 2.

The base fixture 34 supports the audio-signal output circuit board 35. The base fixture 34 is integrated with the holder 32. The audio-signal output circuit board 35 has a shape of a substantially rectangular plate. The audio-signal output circuit board 35 is supported by the base fixture 34. The audio-signal output circuit board 35 is fixed inside the circuit case 3*c* with the base fixture 34. For example, a field effect transistor (FET) and circuits are included in the audio-signal output circuit board 35. The FET constitutes an impedance converter of the electroacoustic transducer 10. The circuits are, for example, circuits convert a variation in the capacitance between the diaphragm 22 and the fixed electrode 24 to electrical signals and output the electrical signals. The gate of the FET is electrically connected to the fixed electrode 24 via the electrode extraction terminal 28, the contact pin 29, and the contact probe 33.

The output transformer 36 includes a secondary coil with a center tap. The output transformer 36 matches the output impedance of a hot signal with the output impedance of a cold signal from the audio-signal output circuit board 35.

The connection member 37 connects the unit case 2*c* and the circuit case 3*c*. The connection member 37 has a shape of a cylinder. The connection member 37 has an external thread portion 37*s*. The external thread portion 37*s* is disposed on the outer circumferential surface of the connection member 37.

The unit case 2*c* is attached to the circuit case 3*c* via the connection member 37. The external thread portion 37*s* of the connection member 37 is fit together with the internal thread portion 2*s* of the unit case 2*c* and the internal thread 3*s* of the circuit case 3*c*.

The connector case 40 is composed of metal, such as brass alloy. The connector case 40 has a shape of a cylinder. The output connector is accommodated in the connector case 40. The output connector, for example, includes the first pin for ground (not shown), the second pin 42 for hot signals, and the third pin 43 for cold signals, and conforms to JEITA Standard RC-5236 "Circular Connectors, Latch Lock Type for Audio Equipment." The first pin is electrically connected to the connector case 40 as ground. The output connector includes a connector base 41. The connector base 41 is composed of an insulating material, such as polybutadiene terephthalate resin. The connector base 41 has a shape of a disc. The first pin, the second pin 42, and the third pin 43 are press-fit to the connector base 41. The first pin, the second pin 42, and the third pin 43 penetrate the connector base 41. The output connector is mounted on the rear end of the circuit case 3*c* with the connector case 40. The connector case 40 also functions as a shield case of the output connector.

The diaphragm 22 vibrates in response to acoustic waves from a sound source entering the unit case 2*c* through the acoustic-wave entering hole 2*h*. The electroacoustic transducer 10 outputs an electric signal in response to the vibration of the diaphragm 22. The condenser microphone 1 outputs the electric signal from the electroacoustic transducer 10 to an external unit via the audio-signal output circuit board 35, the output transformer 36, and the output connector.

CONCLUSION

As described above, the diaphragm according to the present invention is a collection of polygonal regions having different lengths in the MD and TD defined by the ridges and grooves 221 of the first pattern 221. That is, the mechanical anisotropy of the diaphragm 22 that has an appropriate ratio of the length along the MD to the length along the TD of each polygonal region remains small even when heat is applied to the diaphragm 22. As a result, the individual differences in the natural resonance frequencies of the diaphragms 22 of the condenser microphone unit 2 and the condenser microphone 1 are small.

Besides a shape of a circle, the diaphragm according to the present invention may have a shape of a polygon such as a rectangle . In other words, the individual differences in the natural resonance frequencies of the diaphragms having a shape of a rectangle according to the present invention are small.

The embodiment described above describes an example of the case when the diaphragm according to the present invention is applied to the condenser microphone unit 2 converting acoustic waves to electrical signals. Alternatively, the diaphragm according to the present invention may be applied to an electroacoustic transducer that converts electrical signals to acoustic waves. That is, the diaphragm according to the present invention can be applied to driver units for headphones and speakers. In other words, such a driver unit vibrates the diaphragm according to the present invention in response to the electrical signal and generates audio signals (acoustic waves) based on the vibration. In this case, the driver unit is an example of an electroacoustic transducer according to the present invention. Headphones and speakers including such driver units are examples of an electroacoustic transducer apparatus according to the present invention.

When a diaphragm according to the present invention is applied to an electroacoustic transducer that converts electrical signals to acoustic wave, the individual differences in the natural resonance frequencies of the individual electroacoustic transducers and electroacoustic transducer apparatuses are small, as described above.

The invention claimed is:

1. A diaphragm comprising:

a biaxially stretched film stretched in a first direction and a second direction orthogonal to the first direction, wherein an entire surface of the biaxially stretched film has a first pattern and a second pattern, the first pattern has ridges and grooves with a first pitch, the second pattern has ridges and grooves with a second pitch, the ridges and grooves of the second pattern are formed linearly along the second direction and are formed consecutively along the first direction, the ridges and grooves of the second pattern are ridges and grooves forming bellows in the first direction, the bellowing ridges and grooves of the second pattern improve the stretchability in the first direction, the first pitch is longer than the second pitch, the shape of the regions defined by the ridges and grooves of the first pattern is a polygon, and a length of a side along the second direction constituting the polygon is longer than a length of a side adjacent to the side along the second direction.

2. The diaphragm according to claim 1, wherein the regions are hexagonal.

3. The diaphragm according to claim 1, wherein the ridges and grooves of the first pattern are rougher than the ridges and grooves of the second pattern.

4. The diaphragm according to claim 1, wherein a peak-to-valley distance of the ridges and grooves of the second pattern is larger than or equal to the thickness of the diaphragm.

5. An electroacoustic transducer converting acoustic waves to electrical signals, comprising:

the diaphragm according to claim 1, wherein the diaphragm vibrates in response to an acoustic wave.

6. An electroacoustic transducer apparatus comprising:

the electro-acoustic transducer according to claim 5, the electroacoustic transducer converting the acoustic wave to an electrical signal.

7. An electro-acoustic transducer converting electrical signals to acoustic waves, comprising:

the diaphragm according to claim 1, wherein the diaphragm vibrates in response to an electrical signal.

8. An electro-acoustic transducer apparatus comprising:

the electro-acoustic transducer according to claim 7, the electro-acoustic transducer converting the electrical signal to an acoustic wave.

* * * * *